US005682842A

United States Patent [19]

Coleman et al.

[11] Patent Number: 5,682,842

[45] Date of Patent: Nov. 4, 1997

[54] FUEL CONTROL SYSTEM FOR AN INTERNAL COMBUSTION ENGINE USING AN AQUEOUS FUEL EMULSION

[75] Inventors: Gerald N. Coleman, Peoria; James E. Sibley, Metamora, both of Ill.

[73] Assignee: Caterpillar Inc., Peoria, Ill.

[21] Appl. No.: 760,448

[22] Filed: Dec. 6, 1996

Related U.S. Application Data

[60] Provisional application No. 60/026,617, Sep. 24, 1996.

[51] Int. Cl. [6] ..... F02B 47/02

[52] U.S. Cl. ..... 123/25 C; 123/25 E; 123/25 J

[58] Field of Search ..... 123/25 R, 25 C, 123/25 J, 25 E

[56] References Cited

U.S. PATENT DOCUMENTS

| | | | |
|---|---|---|---|
| 4,333,739 | 6/1982 | Neves | 44/52 |
| 4,353,345 | 10/1982 | Ebihara | 123/575 |
| 4,388,893 | 6/1983 | Apfel | 123/25 E |
| 4,495,930 | 1/1985 | Nakajima | 123/575 |
| 4,535,728 | 8/1985 | Batchelor | 123/27 |
| 4,563,982 | 1/1986 | Pischinger et al. | 123/1 A |
| 4,732,114 | 3/1988 | Binder et al. | 123/25 |
| 4,938,606 | 7/1990 | Kunz | 366/134 |
| 4,955,326 | 9/1990 | Helmich | 123/27 |
| 5,092,304 | 3/1992 | King | 123/575 |
| 5,125,366 | 6/1992 | Hobbs | 123/25 |
| 5,174,247 | 12/1992 | Tosa et al. | 123/25 C |
| 5,243,932 | 9/1993 | Herrmann | 123/25 |
| 5,245,953 | 9/1993 | Shimada et al. | 123/25 C |
| 5,400,746 | 3/1995 | Susa et al. | 123/25 |
| 5,529,024 | 6/1996 | Wirbeleit et al. | 123/25 C |
| 5,535,708 | 7/1996 | Valentine | 123/25 |
| 5,542,379 | 8/1996 | Kessler | 123/25 C |

FOREIGN PATENT DOCUMENTS

| | | | |
|---|---|---|---|
| 2835099 | 3/1979 | Germany | 123/25 C |
| 1126708 | 11/1984 | U.S.S.R. | 123/25 E |

*Primary Examiner*—Erick R. Solis
*Attorney, Agent, or Firm*—Robert J. Hampsch

[57] ABSTRACT

A method and system for the control of the overall water content of an aqueous fuel in an internal combustion engine is provided. The disclosed fuel control system includes a post add water system and a control valve that is responsive to selected engine operating characteristics such as engine operating temperature, engine load, and carbon monoxide levels in the engine exhaust. The post add water system is adapted for selectively providing an additional supply of purified water via the control valve to the aqueous fuel in the fuel line. The fuel system controller is operatively associated with the control valve to regulate the quantity of water added and thereby control the overall content of water in the aqueous fuel emulsion delivered to the fuel injectors.

20 Claims, 4 Drawing Sheets

FUEL CONTROL SYSTEM FOR AN INTERNAL COMBUSTION ENGINE USING AN AQUEOUS FUEL EMULSION

CROSS REFERENCE TO RELATED APPLICATIONS

This application is based, in part, on the material disclosed in United States provisional patent application serial number 60/026617 filed Sep. 24, 1996.

FIELD OF THE INVENTION

The present invention relates to a fuel control system for an internal combustion engine and more particularly, to a fuel control system for an internal combustion engine that utilizes a water fuel emulsion as a source of fuel. Still more particularly, the present invention relates to a method and system for optimizing emissions performance of an internal combustion engine that utilizes a water fuel emulsion by actively controlling the water content of the fuel emulsion in response to selected engine operating and performance parameters.

BACKGROUND

Recent fuel developments have resulted in a number of aqueous fuel emulsions comprised essentially of a carbon based fuel, water, and various additives such as lubricants, surfactants, corrosion inhibitors, cetane improvers, and the like. It is the additives that act to couple the water molecules with the carbon based fuel without separation. These aqueous fuel emulsions may play a key role in finding a cost-effective way for internal combustion engines including, but not limited to, comprising ignition engines (i.e. diesel engines) to achieve the reduction in emissions below the mandated levels without significant modifications to the engines, fuel systems, or existing fuel delivery infrastructure.

Advantageously, aqueous fuel emulsions tend to reduce or inhibit the formation of nitrogen oxides (NOx) and particulates (i.e. combination of soot and hydrocarbons) by altering the way the fuel is burned in the engine. Specifically, the fuel emulsions are burned at somewhat lower temperatures than a comparable non-aqueous fuel due to the presence of water. This, coupled with the realization that at higher peak combustion temperatures, more NOx are typically produced in the engine exhaust, one can readily understand the advantage of using aqueous fuel emulsions.

Thus, the reduction in NOx is achieved using aqueous fuels primarily because an aqueous fuel emulsion has a lower peak combustion temperature. The actual reduction achieved, however, depends on a number of factors including the composition of the fuel emulsion (e.g. fuel to water ratio), engine/ignition technology, engine operating conditions, etc. Moreover, having a lower peak combustion temperature does not necessarily mean that the aqueous fuel is providing less total energy or doing less work for a given mass of hydrocarbon fuel. Rather, the addition of water only requires a proportional increase in the volume of aqueous fuel to be injected in order to achieve the equivalent amount of work. However, as the volume of fuel that has to be injected increases, the engine performance considerations change. For example, the additional volume of aqueous fuel required in order to achieve the same amount of work imposes additional constraints and other design considerations in the fuel delivery systems, fuel control systems, fuel storage systems and other related systems in the compression ignition engine.

Several related art devices have devised various devices or techniques for controlling the addition of water for the purposes of reducing NOx levels. For example, U.S. Pat. No. 4,938,606 (Kunz) discloses an apparatus for producing a water-in-oil emulsion for internal combustion engines that employs an oil line, a water line, a dosing apparatus and various mixing and storage chambers, yet does not disclose any preferred controlling techniques. See also U.S. Pat. No. 5,535,708 (Valentine) which discloses a process for reducing NOx emissions from diesel engines by forming an emulsion of an aqueous urea solution in diesel fuel and combusting the same.

Other related art devices include U.S. Pat. Nos. 4,732,114 (Binder et al.); 5,400,746 (Susa et al.); 4,563,982 (Pischinger et al.), and 5,125,366 (Hobbs) all of which disclose various devices and processes for combining water and fuel at or near the engine cylinder for the purposes of reducing emissions such as NOx. The specified quantities of water and fuel introduced into the engine cylinder is a function of the engine operating conditions.

SUMMARY OF THE INVENTION

The present invention addresses some of the above-identified concerns by providing a method and system for optimizing emissions performance of an internal combustion engine that utilizes an aqueous based fuel emulsion.

In one embodiment, the invention may be characterized as an aqueous fuel control system that effectively controls the water content of an aqueous fuel composition. The disclosed aqueous fuel control system includes a fuel delivery system adapted to provide a prescribed supply of 'fuel in water' emulsion to be injected to the engine as a function of one or more defined engine parameters. The 'fuel in water' emulsion is supplied to the engine via a fuel line into which a prescribed amount of additional purified water is added to the fuel emulsion in the fuel line by a post add water system. The disclosed post add water system includes a source of water in fluid communication with the fuel line, a water purification system, and a control valve. The control valve being generally responsive to a control unit and adapted to introduce a prescribed volume of additional purified water to the fuel line, the prescribed volume being a function of engine load, or engine performance (including engine emissions) or both.

The invention may also be characterized as a method of controlling the water content of a water fuel emulsion delivered to one or more fuel injectors in an internal combustion engine. The disclosed method basically includes five steps the first of which involves supplying a prescribed quantity of a water fuel emulsion at a prescribed pressure to the fuel injectors via a fuel line. The second step involves determining an additional quantity of water to supply to the water fuel emulsion in the fuel line. This determination is based on selected engine operating characteristics, such as engine load, engine operating temperature, engine exhaust emissions or any combination thereof. The third step involves supplying the additional quantity of water, preferably purified water, to the water fuel emulsion at a selected location in the fuel line upstream of the injectors. The next step involves mixing the additional quantity of water with the water fuel emulsion using an in-line mixer upstream of the fuel injectors thereby yielding a mixed water fuel emulsion having a prescribed water content. Finally, the mixed water fuel emulsion having the prescribed water content is injected into the engine cylinders.

It should be appreciated by those persons skilled in the art that a central aspect of the present invention is the ability to introduce and thoroughly mix a volume of additional purified water to the original aqueous fuel emulsion as the fuel emulsion is transported in the fuel line to the engine for combustion. The introduction of additional water to the original fuel emulsion allows for the control of the overall water content in the burned fuel in order to collectively optimize engine performance, engine emissions, and engine operating cost.

Another aspect of the present invention is to provision of a controlling mechanism which controls the percent water contained in the fuel emulsion as a function of engine load, engine performance, engine operating temperature or any combination thereof.

An important feature of the present invention related to the above-identified aspects is realized in the ability and desirability to control the overall water content of in the fuel emulsion as a function of engine emissions, such as nitrogen oxides (NOx) and carbon monoxide (CO).

Another feature of the present invention is embodied in the use of an emissions sensor located proximate the engine exhaust in order to detect the presence and level of carbon monoxide in the engine exhaust. The level of carbon monoxide, as measured by the sensor is input to the engine controller unit where it is processed together with various other engine operating parameters to produce a prescribed control signal which operatively controls the quantity of water added to the aqueous fuel emulsion.

Still another related feature of the present invention is realized in the ability and desirability to control the introduction of additional water to the fuel emulsion as a function of engine operating temperature or engine coolant temperature. Basically, under cold start and cold running conditions, the addition of extra water should be suspended or at least minimized. The engine operating temperature can be ascertained using an appropriately placed temperature sensor.

BRIEF DESCRIPTION OF THE DRAWINGS

The above and other aspects, features, and advantages of the present invention will be more apparent from the following, more descriptive description thereof, presented in conjunction with the following drawings, wherein.

Corresponding reference numbers indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principals of the invention. The scope of the invention should be determined with reference to the claims.

Figure 1:
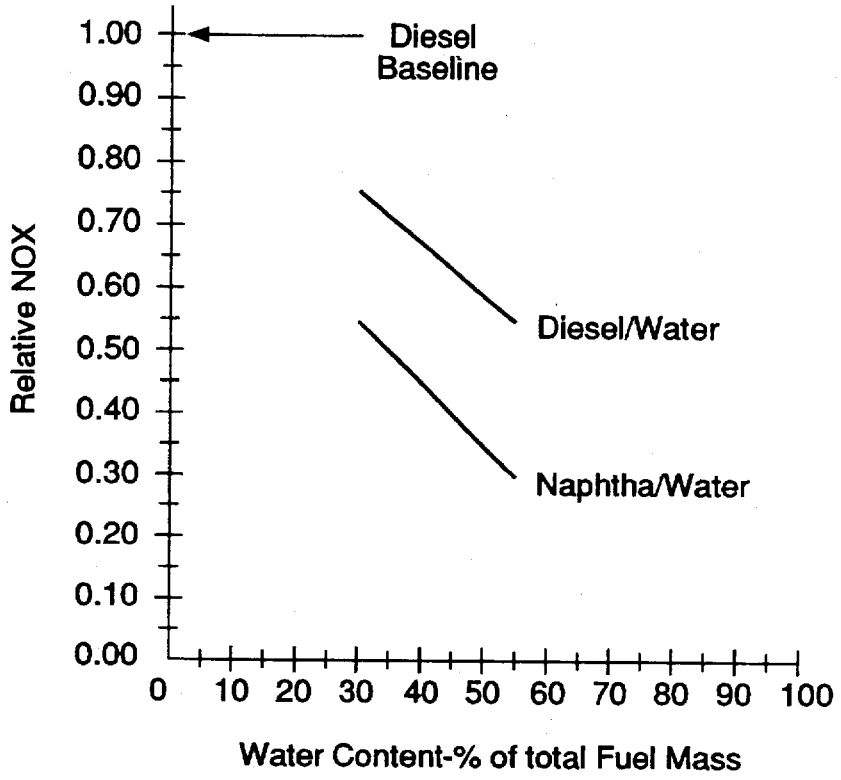
FIG. 1 is a graphical representation of the relative NOx emissions as a function of water content in an aqueous fuel emulsion.

Turning now to the drawings and particularly to FIG. 1, there is shown a graphical representation of the relative NOx emissions as a function of water content of the fuel for both a diesel fuel and water emulsion as well as a naphtha fuel and water emulsion. FIG. 1 shows that as the percent water in a water fuel emulsion is increased, the NOx emissions are reduced.

Disadvantageously, however, as the percent of water in the water fuel emulsion is increased the engine performance at light loads is sacrificed. This is a result of the fact that the cetane number of the water fuel emulsion is reduced with increasing water content. Furthermore, it has been recognized that the increased water content of a water fuel emulsion may also contribute to engine starting problems. In addition, fuel shipping and handling costs typically increase as the water content of the water fuel emulsion, as a percentage of total mass, is increased. As a result, there is a compromise which must be made between optimum emissions levels, engine performance and fuel cost.

Figure 2:
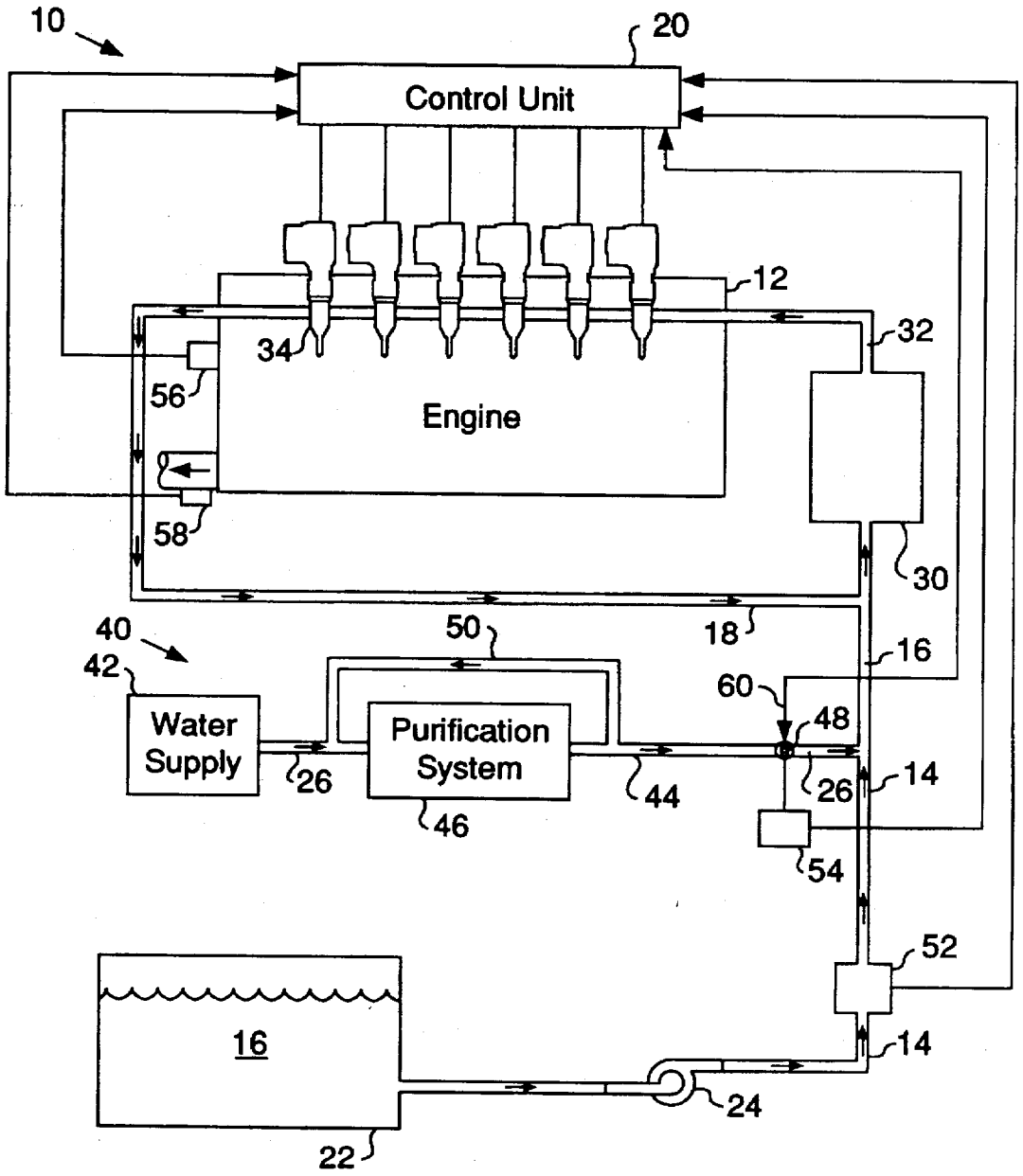
FIG. 2 is a schematic representation of the aqueous fuel control system for an internal combustion engine using a 'fuel in water' emulsion in accordance with one embodiment of the invention.

Turning next to FIG. 2, there is shown a schematic representation of one embodiment of the fuel control system 10 for an internal combustion engine 12 using a fuel in water emulsion. The system 10 is comprised of an internal combustion engine 12 adapted to receive a prescribed quantity of fuel via a fuel supply conduit or fuel line 14. The prescribed fuel quantity and flow rate is preferably determined by an engine control unit 20 as a function of one or more engine operating parameters. For example, the fuel supply 16 to the engine may be determined by the actual speed of the engine 12, the desired speed of the engine 12, the operating temperatures of the engine 12, and other engine operating and control parameters generally known to those persons skilled in the art. Any excess fuel supplied to the engine 12 and not consumed thereby is typically returned via a return conduit 18 to the fuel line 14.

In the illustrated schematic, the fuel 16 is a fuel in water emulsion residing in a fuel tank 22 or similar such fuel reservoir. A prescribed flow rate of the fuel in water emulsion 16 is fed from the fuel tank 22 to the engine 12 by means of a fuel pump 24 disposed in fluid communication with the fuel line 14. Along the way, a prescribed amount of additional water 26 is introduced to the fuel line 14 via a pump or similar device thereby supplementing the fuel in water emulsion 16. The original emulsion 16 and additional water 26 are subsequently mixed by an in-line mixer 30 resulting in a modified fuel in water emulsion 32 potentially having a different ratio of fuel and water than the emulsion 16 residing in the fuel tank 22. The mixed fuel in water emulsion 32 is then injected into the engine 12 via appropriately controlled fuel injectors 34 for combustion.

The ability to introduce additional water to a fuel in water emulsion is one of the advantageous features of many advanced aqueous fuels. The post add water system 40 in the illustrated schematic includes a source of water 42 in fluid communication with the fuel line 14, a water conduit 44, a water purification system 46, a control valve 48, and a water return conduit 50.

The actual amount of water 26 added to the original fuel in water emulsion 16 is controlled by the valve 48 near the outlet of the water purification system 40. The valve 48 is controlled in response to the engine load and/or other indicative parameters such as the flow rate of the fuel in water emulsion 16 measured by an appropriate sensor 52 at an upstream position in the fuel line 14.

Figure 3:
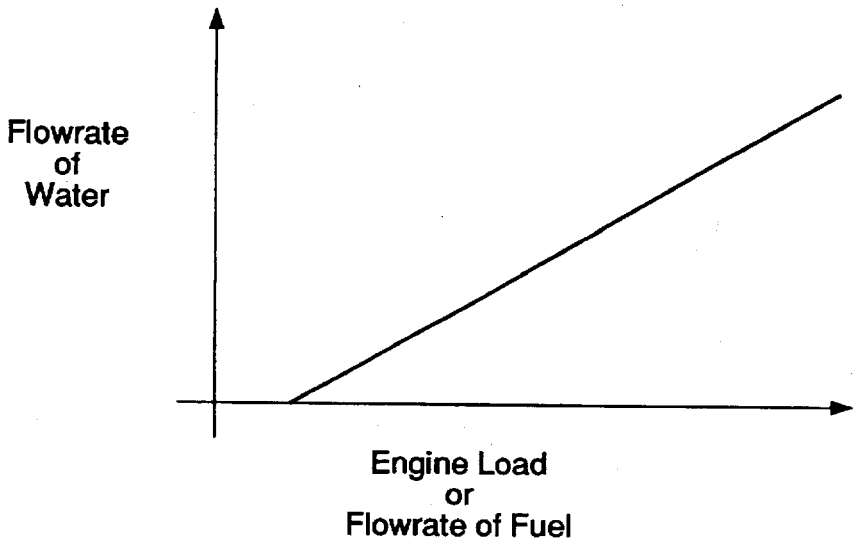
FIG. 3 is a graphical representation of the desired relationship between the engine load and the flowrate of water added to the fuel line.

For example, a simple technique for controlling the water flowrate of the post add water system is to measure the engine load or the flow rate of the water fuel emulsion measured at an upstream location relative to the post add water system using fuel flow sensor 52. FIG. 3 depicts a graphical representation of the preferred controlling relationship between the engine load or upstream fuel flow rate and the flow rate of water added by the post add water system as measure by water flow sensor 54. As seen therein, as the engine load and/or the fuel flow rate measured at an upstream position in the fuel line is increased, the flow rate of purified water passing through control valve 48 is also increased. Also, as the engine load or flow rate measured at an upstream position in the fuel line is reduced, the flow rate of purified water is decreased.

As indicated above, it has been recognized that the increased water content of a fuel in water emulsion contributes to engine starting problems. Accordingly, the disclosed embodiment of the fuel control system, functionally depicted back in FIG. 2, is further adapted to prevent the addition of water by the post add water system until the engine was operating at or near a predetermined operating temperature. This is preferably accomplished by monitoring the engine coolant temperature with an appropriately located temperature sensor 56, since engine coolant temperature for many engines has a well established relationship to engine operating temperature. As soon as the engine coolant temperature reaches a predetermined temperature value, the post add water system becomes operational. If the engine coolant temperature is below the predetermined temperature value, the valve associated with the post add water system remains closed. This feature will allow for the best cold start/cold mode operation possible. Another control feature that would be beneficial is that water would not be post added until the engine was at or near operating temperature, as measured by temperature sensor 56.

FIG. 2 also depicts yet another approach for controlling the water flow rate of the post add water system is to utilized the measured level of carbon monoxide (CO) in the engine exhaust as measure by an emissions sensor 58. Carbon monoxide is a good indicator of overall engine performance. When the presence of carbon monoxide in the exhaust increases dramatically the engine performance is generally unacceptable. If, however, the level of carbon monoxide present within the engine exhaust is below an acceptable limit, then the engine performance is typically considered to be acceptable. In addition, since a higher water content in the fuel emulsion may result in a higher carbon monoxide level in the engine exhaust for a given engine operating condition, the addition and removal of water from the fuel emulsion directly affects engine performance and exhuast emissions.

To that end, the disclosed embodiment of the fuel control system is further adapted to measure the level of carbon monoxide in the engine exhaust and increase the water content if the carbon monoxide was below some threshold level of carbon monoxide (e.g., 800 ppm). Conversely, the water content would be reduced if the carbon monoxide level in the exhaust was above some other predetermined threshold level of carbon monoxide (e.g., 1000 ppm). The predetermined carbon monoxide threshold levels specified as well as the actual controlling relationship between carbon monoxide levels and the volume or flow rate of water added by the post add water system is preferably tailored to the particular engine, the anticipated operating environment, and the specific application in which it is used.

Other engine operating parameters such as intake air temperature or intake manifold pressure could be used to control, either alone or in conjunction with the aforementioned engine performance parameters (e.g. load, emissions, temperature), the percent of water added by the post add water system. For example, on turbocharged engines, the percent of water in the aqueous fuel emulsion injected into the cylinders is preferably increased as the boost pressure increases. The higher boost pressure typically results when higher engine load is applied. At higher altitudes (i.e. low ambient pressures), the engine performance is more sensitive to poor ignition quality fuel, such as the present aqueous fuel emulsions. The lower ambient pressures, reflected in the measured absolute intake manifold pressure, can thus be used to control the actual amount of water added or total water content of the aqueous fuel emulsion.

Another example involves controlling the actual amount of water added by the post add water system to the transported fuel in response to the intake manifold air temperature. Since the engine performance is more sensitive to poor ignition quality fuels at lower intake manifold air temperatures, the percent of water in the aqueous fuel emulsion should be reduced as the intake air temperature is lowered.

Figure 4:
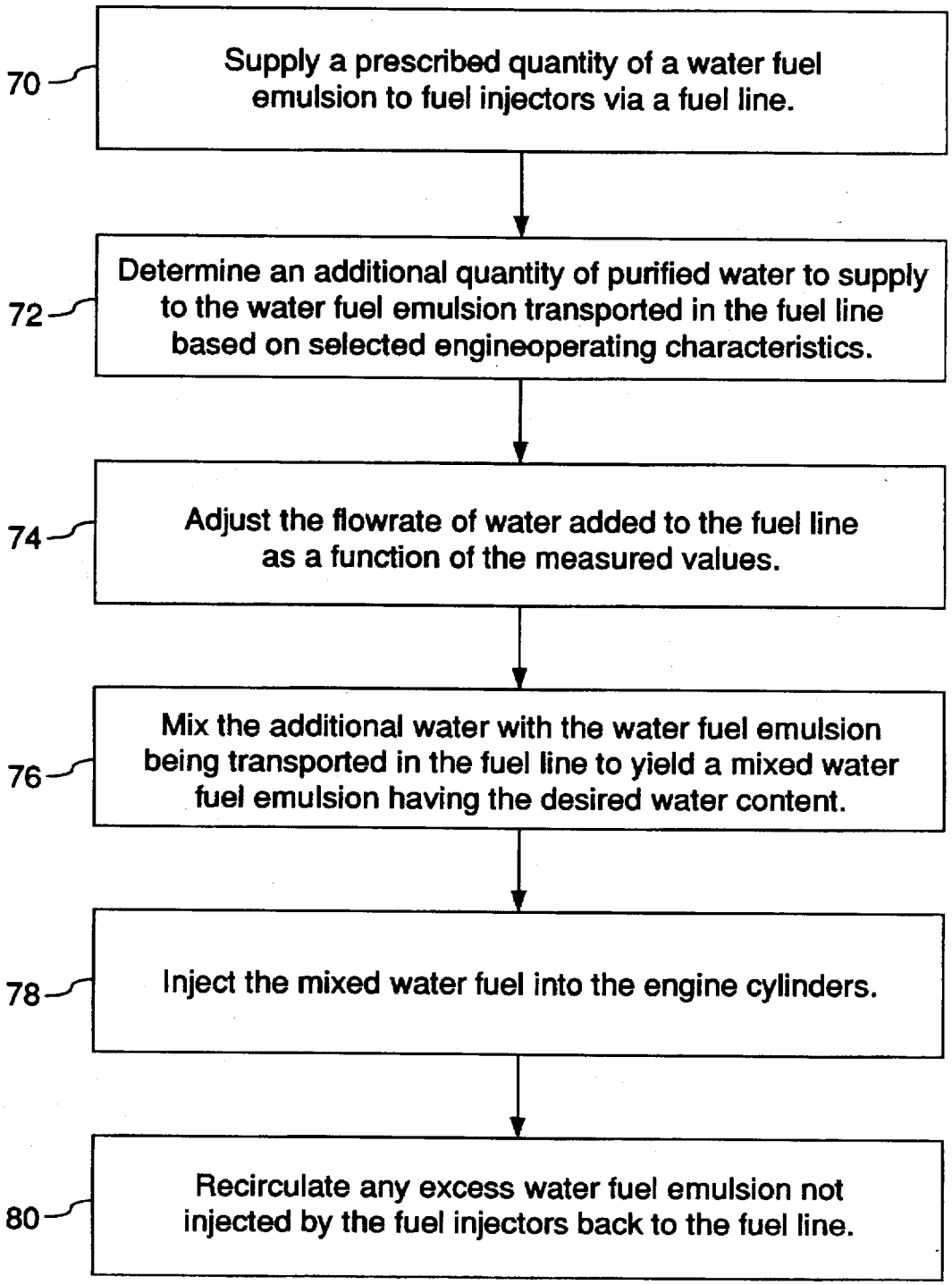
FIG. 4 is a functional block diagram depicting the various control relationships implemented within the disclosed embodiments of the present invention.
Figures 1, 5:
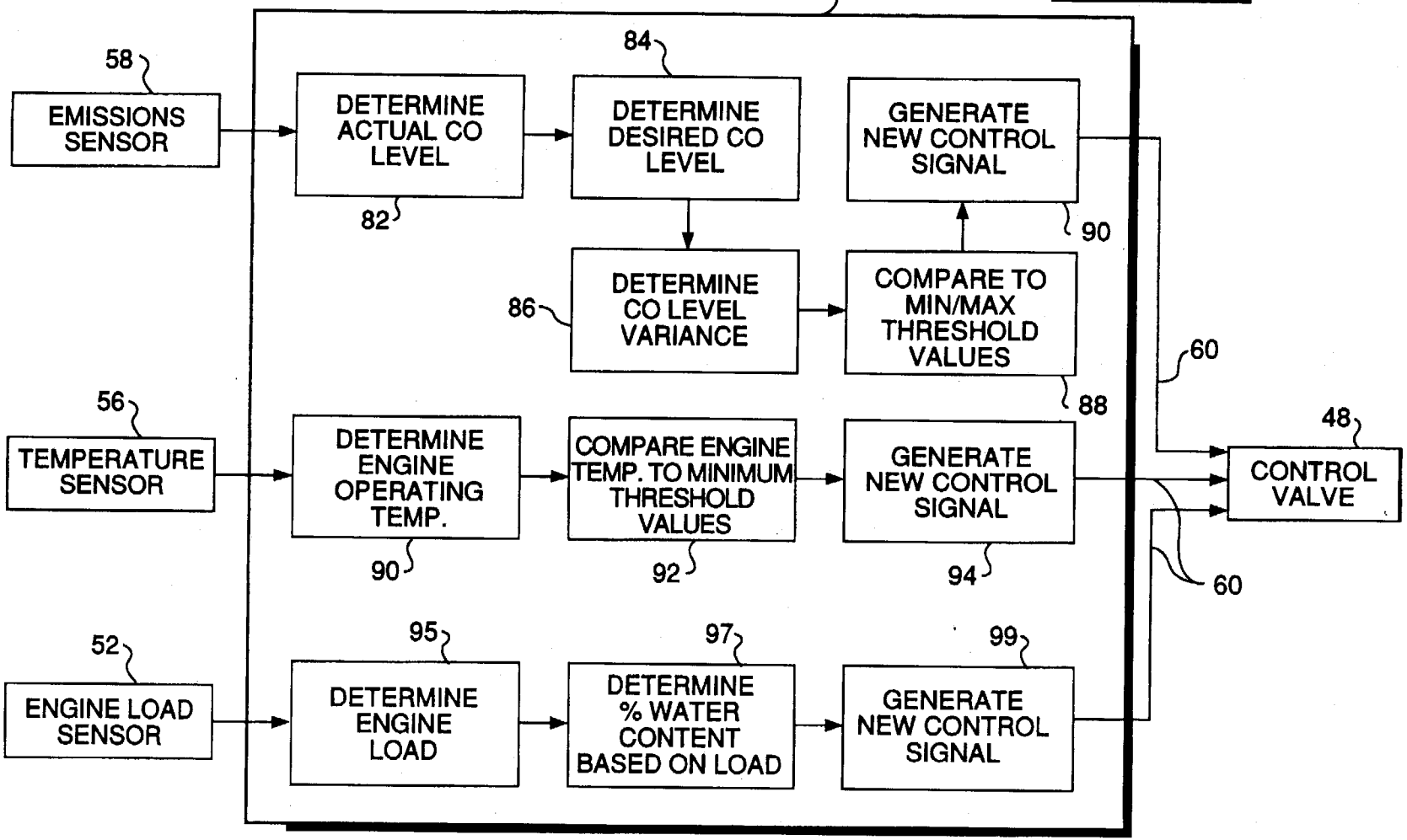
FIG. 5 is a flow chart depicting the various steps involved in the preferred method for controlling the water content of the water fuel emulsion based on selected engine operating characteristics in accordance with the present invention.

Referring now to FIGS. 4 and 5, there are shown block diagrams generally depicting the preferred methods for controlling the addition of extra water to the fuel in an internal combustion engine using an aqueous fuel emulsion as a source of fuel. As seen in FIG. 4, the basic method includes the following six steps: (a) supplying a prescribed quantity of a water fuel emulsion at a prescribed pressure from a fuel tank to one or more fuel injectors of an internal combustion engine via a fuel line (block 70); (b) determining an additional quantity of water to supply to the water fuel emulsion being transported in the fuel line based on selected engine operating characteristics, such as engine load, engine operating temperature, engine exhaust emissions or any combination thereof (block 72); (c) supplying the additional quantity of purified water at a selected location in the fuel line upstream of the injectors (block 74); (d) mixing the additional quantity of water with the water fuel emulsion being transported in the fuel line using an in-line mixer thereby yielding a mixed water fuel emulsion having a desired water content (block 76); (e) injecting the mixed water fuel into the engine cylinders (block 78); and (f) recirculating any excess water fuel emulsion not injected by the fuel injectors back to the fuel line at a second location downstream of the location where water is added to the fuel line (block 80).

Turning now to FIG. 5, the step or process of determining the additional quantity of water to supply to the water fuel emulsion being transported in the fuel line based on selected engine operating characteristics may involve first measuring the engine coolant temperature using an appropriately located temperature sensor 56, measuring the engine load with an appropriate load sensor 52 and/or measuring various constituent elements in the exhaust with an emissions sensor 58. Given the aforementioned parameters, a control unit 20 is used to determine an adjustment in the flowrate of water through the control valve 48 as a function of the measured parameter values using various algorithms, look-up tables or similar processor based techniques.

For example, the method of adjusting the water added to the fuel line as a function of the measured carbon monoxide levels present in the engine exhaust may involve first ascertaining the actual level of carbon monoxide emissions present in the exhaust of the engine (block 82). Concurrently or sequentially, a desired level of carbon monoxide emissions in the exhaust is determined (block 84). The next step involves determining a variance or error in the level of carbon monoxide emissions in the exhaust (block 86) by comparing the desired level of carbon monoxide emissions to the actual level of carbon monoxide emissions present in the exhaust. The variance is then compared to minimum and maximum threshold values (block 88). The last step is to generate a control signal (block 90) corresponding to the relative position of the control valve 48 between a predetermined minimum valve position and a predetermined maximum valve position as a function of the variance in the level of carbon monoxide emissions in the exhaust of the engine. Finally, a valve position control signal 60 is forwarded to the control valve 48 thereby adjusting the flowrate of water added to the fuel line of the engine.

Likewise, another method of determining the volume of water added to the fuel line makes such determination as a function of the engine operating temperature. As depicted in FIG. 5, this approach involves first determining the engine operating temperature (block 90) based on the signal provided by the temperature sensor 56. Since the volume of water added to the fuel line is of most concern at cold start and cold running operating conditions, the engine operating temperature is preferably compared to a minimum threshold value (block 92). If the determined engine operating temperature is below the minimum temperature threshold, little or no water is added by the post add water system and the control unit 20 generates the appropriate control signal 60 to the control valve 48 (block 94). If, however, the engine operation temperature is at or above a minimum threshold temperature value, the control unit 20 generates an appropriate control signal 60 to the control valve 48 to allow the appropriate volume of water to the fuel line (block 94).

In addition, there is also shown a method of determining the volume of water added to the fuel line as a function of the engine load. This method involves first measuring the engine load with an appropriate fuel flow sensor 52, determining the actual engine load (block 95), determining the percent water content of the desired fuel emulsion based on the actual engine load (block 97), and generating the appropriate control signal to achieve the desired water and fuel concentration (block 99). This method of adjusting the volume of water added to the fuel line is particularly useful when the engine is operating at light loads and the volume of water added should be diminished.

From the foregoing, it should be appreciated that the above-disclosed embodiment of the fuel control system provides the ability to control the volume or flow rate of purified water added by a post add water system as a function of engine load, flow rate of the fuel emulsion at a location upstream of the post add water system, engine operating temperature, or engine exhaust emission levels. Moreover, each of the above-identified techniques for controlling the water flow rate of the post add water system can be utilized alone or in conjunction with other controlling techniques. More importantly, each of the above-identified controlling techniques are easily tailored to the particular engine and the anticipated operating environment in which the engine is used.

While the invention herein disclosed has been described by means of specific embodiments and processes associated therewith, numerous modifications and variations can be made thereto by those skilled in the art without departing from the scope of the invention or sacrificing all its material advantages.

What is claimed is:

1. A fuel control system for an internal combustion engine that utilizes a fuel in water emulsion as a source of fuel, the fuel control system comprising:

a fuel system including one or more fuel injectors adapted to inject said fuel in water emulsion into the engine cylinders and a fuel line in fluid communication with said fuel injectors through which said fuel in water emulsion is transported;

a post add water system in fluid communication with said fuel line and adapted for selectively providing an additional supply of water to said fuel in water emulsion in said fuel line; and a control unit operatively associated with said fuel system and said post add water system to control the water content of said fuel in water emulsion delivered to said fuel injectors as a function of selected engine operating characteristics.

2. The fuel control system of claim 1 further including a mixing apparatus disposed along said fuel line upstream of said fuel injectors, said mixing apparatus adapted for mixing said fuel in water emulsion with said additional supply of water.

3. The fuel control system of claim 1 wherein said fuel system further includes:

a fuel tank attached to an end of said fuel line and adapted for holding a supply of said fuel in water emulsion;

a fuel pressurizing device disposed in fluid communication along said fuel line upstream of said post add water system and adapted for transporting said fuel in water emulsion under pressure from said fuel tank to said fuel injectors via said fuel line at a desired fuel flow rate.

4. The fuel control system of claim 3 wherein said fuel system further includes a recirculation conduit for passing excess fuel from said fuel injectors to said fuel line at a location downstream of said post add water system.

5. The fuel control system of claim 1 further including a temperature sensor operatively coupled to said control unit and adapted for providing a temperature signal corresponding to engine coolant temperature, and wherein the water content of said fuel in water emulsion delivered to said fuel injectors is a function of said engine coolant temperature.

6. The fuel control system of claim 1 further including an emissions detector operatively coupled to said control unit and adapted providing an emissions signal corresponding to the carbon monoxide content in the engine exhaust, and wherein the water content of said fuel in water emulsion delivered to said fuel injectors is a function of said carbon monoxide content in the engine exhaust.

7. The fuel control system of claim 1 further including an emissions detector operatively coupled to said control unit and adapted providing an emissions signal corresponding to the NOx content in the engine exhaust, and wherein the water content of said fuel in water emulsion delivered to said fuel injectors is a function of said NOx content in the engine exhaust.

8. The fuel control system of claim 1 further including an engine load sensor operatively coupled to said control unit and adapted providing an engine load signal corresponding to the engine load, and wherein the water content of said fuel in water emulsion delivered to said fuel injectors is a function of said engine load.

9. The fuel control system of claim 8 wherein said engine load is determined using a fuel flow rate sensor for sensing the flow rate of the fuel in water emulsion in the fuel line upstream of said post add water system.

10. The fuel control system of claim 1 wherein said post add water system further includes:

a source of water adapted for providing said additional supply of water;

a water conduit connecting said source of water with said fuel line;

a water purification unit disposed along said water conduit for purifying said water prior to mixing with said fuel in water emulsion;

a control valve disposed along said water conduit said control valve being responsive to said control unit for selectively providing said additional supply of water from said water source to said fuel in water emulsion in said fuel line thereby controlling the water content of said fuel in water emulsion delivered to said fuel injectors.

11. A fuel control system for an internal combustion engine that utilizes a fuel in water emulsion as a source of fuel, the fuel control system comprising:

a fuel system including one or more fuel injectors adapted to inject said fuel in water emulsion into said engine cylinders and a fuel line in fluid communication with said fuel injectors through which said fuel in water emulsion is transported;

a control unit operatively associated with said fuel system and further adapted to receive inputs generally indicative of selected engine operating characteristics;

a post add water system in fluid communication with said fuel line and adapted for providing an additional supply of water to said fuel in water emulsion in said fuel line; and a control valve interposed between said post add water system and said fuel line and responsive to said control unit to introduce a prescribed volume of said additional supply of water to the fuel line and control the water content of said fuel in water emulsion delivered to said fuel injectors, said prescribed volume being a function of said engine operating characteristics.

12. The fuel control system of claim 11 further including a mixing apparatus disposed along the fuel line upstream of said fuel injectors, said mixing apparatus adapted for mixing said fuel in water emulsion with said prescribed volume of water.

13. The fuel control system of claim 11 further including a temperature sensor adapted for providing a temperature signal corresponding to engine operating temperature, said temperature sensor operatively coupled to said control unit and control valve such that the water content of said fuel in water emulsion delivered to said fuel injectors is a function of said engine operating temperature.

14. The fuel control system of claim 13 further including an emissions detector adapted providing an emissions signal corresponding to the carbon monoxide content in the engine exhaust, said emissions detector being operatively coupled to said control unit and control valve such that the water content of said fuel in water emulsion delivered to said fuel injectors is a function of the carbon monoxide present in the engine exhaust and engine operating temperature.

15. The fuel control system of claim 13 further including an engine load sensor adapted providing an engine load signal, said engine load sensor being operatively coupled to said control unit and said control valve such that the water content of said fuel in water emulsion delivered to said fuel injectors is a function of the engine load and engine operating temperature.

16. A method of controlling the water content of a fuel in water emulsion delivered to one or more fuel injectors in an internal combustion engine comprising the steps of:

supplying a prescribed quantity of said fuel in water emulsion at a prescribed pressure from a source of fuel in water emulsion to said fuel injectors via a fuel line;

determining an additional quantity of water to supply to said fuel in water emulsion in said fuel line as a function of engine operating characteristics;

supplying said additional quantity of water from a source of water to said fuel in water emulsion at a selected location in said fuel line, said selected location being upstream of said injectors;

mixing said additional quantity of water with said fuel in water emulsion upstream of said fuel injectors to yield a mixed fuel in water emulsion having a prescribed water content; and injecting said mixed fuel in water emulsion having said prescribed water content into the engine cylinders.

17. The method of claim 16 wherein the step of determining an additional quantity of water to supply to said fuel in water emulsion in said fuel line further comprises the steps of:

determining the engine operating temperature; and determining said additional quantity of water to supply to said fuel in water emulsion as a function of engine operating temperature.

18. The method of claim 16 wherein the step of determining an additional quantity of water to supply to said fuel in water emulsion in said fuel line further comprises the steps of:

determining the engine load; and determining said additional quantity of water to supply to said fuel in water emulsion as a function of engine load.

19. The method of claim 16 wherein the step of determining an additional quantity of water to supply to said fuel in water emulsion in said fuel line further comprises the steps of:

determining the carbon monoxide levels present in said engine exhaust; and determining said additional quantity of water to supply to said fuel in water emulsion as a function of said carbon monoxide levels present in said engine exhaust.

20. The method of claim 16 further comprising the additional step of recirculating any excess fuel in water emulsion not injected by said fuel injectors back to said fuel line downstream of said selected location in said fuel line.

* * * * *